US006618975B1

(12) United States Patent
Shih

(10) Patent No.: US 6,618,975 B1
(45) Date of Patent: Sep. 16, 2003

(54) PAINTBALL GUN CONVENIENTLY ASSEMBLED

(76) Inventor: Pao-Tung Shih, P.O. Box 90, Tainan City, Taiwan (CN)

( * ) Notice: Subject to any disclaimer, the term of this patent is extended or adjusted under 35 U.S.C. 154(b) by 0 days.

(21) Appl. No.: 10/319,574

(22) Filed: Dec. 16, 2002

(51) Int. Cl.[7] ..... F41A 21/00

(52) U.S. Cl. ..... 42/75.03; 42/69.01; 124/56; 124/73; 124/80; 124/31

(58) Field of Search ..... 42/75.03, 69.01; 124/56, 71, 73, 80, 31

(56) References Cited

U.S. PATENT DOCUMENTS 4,109,402 A * 8/1978 Guardamino ..... 42/65
5,052,141 A * 10/1991 Sammons ..... 42/69.01
5,105,569 A * 4/1992 Straitiff ..... 42/2
5,974,611 A * 11/1999 Casella ..... 15/3.52
6,138,656 A * 10/2000 Rice et al. ..... 124/73
6,374,528 B1 * 4/2002 Davis et al. ..... 42/71.01
6,439,217 B1 * 8/2002 Shih ..... 124/77
6,520,171 B2 * 2/2003 Reible ..... 124/73

* cited by examiner

*Primary Examiner*—Michael J. Carone
*Assistant Examiner*—Michelle Thomson

(57) ABSTRACT

A paintball gun conveniently assembled in the present invention has a through hole formed in a back of a grip and communicated with a chamber of the grip; a set bolt having an engagement groove and being extended into the through hole, protruded into the chamber and pressed against a magnetic-attraction plate; a setscrew hole formed in one sidewall of the grip and communicated with the through hole for being screwed with a setscrew, whereby the set bolt designed with different length can be extended into the through hole to push the magnetic-attraction plate, and then screwed with the setscrew tightly so that a push rod of the magnetic-attraction plate can push a locking member to adjust the displacement height of the locking member for different types of the gun bodies, thus a single grip is suited for being conveniently and quickly assembled with a gun body of different style.

1 Claim, 5 Drawing Sheets

PAINTBALL GUN CONVENIENTLY ASSEMBLED

BACKGROUND OF THE INVENTION

1. Field of the Invention

This invention relates to a paintball gun conveniently assembled, particularly to one having a through hole formed in a back of a grip, communicated with a chamber of the grip; a set bolt provided with at least one engagement groove disposed thereon and capable of being extended into the through hole with an inner end protruded into the chamber and pressed against one wall surface of a magnetic-attraction plate; a setscrew hole formed in one sidewall surface of the grip and communicated with the through hole for being screwed with a setscrew, by which the set bolt designed to have different length for being assembled with a gun body of different style can be extended into the through hole to push the magnetic-attraction plate, and then screwed with the setscrew tightly to keep the set bolt in a fixed position so that a push rod of the magnetic-attraction plate can push a lower end of a locking member to adjust the displacement height of an upper end of the locking member to be fitted with different types of gun bodies, thus a single grip is suited for being conveniently and quickly assembled with a gun body of different style.

2. Description of the Prior Art

A known conventional paintball gun, as shown in FIG. 1, mainly includes a grip 1 and a gun body 2. A recess 10 is disposed inside the grip 1 and provided with a circuit board 11 and an electromagnet 12 therein. A chamber 13 disposed above the recess 10 and communicated with the recess 10 is provided with an electromagnetic valve 14 therein. A magnetic-attraction plate 15 disposed at one side of the electromagnetic valve 14 has a push rod 150 extended through the electromagnetic valve 14 and protruded from the other side of the electromagnetic valve 14. A locking member 16 pivoted on an upper portion of the grip 1 has an upper end whose bottom is urged upward by a spring 17 disposed below and a lower end pushed against by an outer end of the push rod 150. A trigger 18 disposed in front of the grip 1 has an actuator 19 located in back of the trigger 18. The grip 1 is fixed beneath the gun body 2. The gun body 2 has a slide way 20 disposed at a bottom of the gun body 2 for accommodating the upper end of the locking member 16, an air chamber 21 provided with a recoil rod 22 therein. A locking groove 23 is formed at a bottom of the recoil rod 22 for firmly engaging the locking member 16. A firing chamber 24 located above the air chamber 21 has a pull rod 25 disposed at a rear of the firing chamber 24 and provided with a linking rod 26 connected with the recoil rod 22, by which a pull of the pull rod 25 will make the recoil rod 22 moved accordingly.

However, the known conventional paintball gun has the locking member 16 of the grip 1 with a fixed height in its engaging position hard to be make any adjustment, which is only suited for being combined with one specific gun body 2. In case of being combined with a different gun body 2, a fitted grip 1 is required and thus greatly increases the production cost.

SUMMARY OF THE INVENTION

The main purpose of the invention is to offer a paintball gun capable of being assembled conveniently and quickly.

The main feature of the invention is to provide a paintball gun conveniently assembled having a through hole formed in a back of a grip and communicated with a chamber of the grip; a set bolt provided with at least one engagement groove disposed thereon and capable of being extended into the through hole with an inner end protruded into the chamber and pressed against a wall surface of a magnetic-attraction plate; a setscrew hole formed in one sidewall surface of the grip and communicated with the through hole for being screwed with a setscrew.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
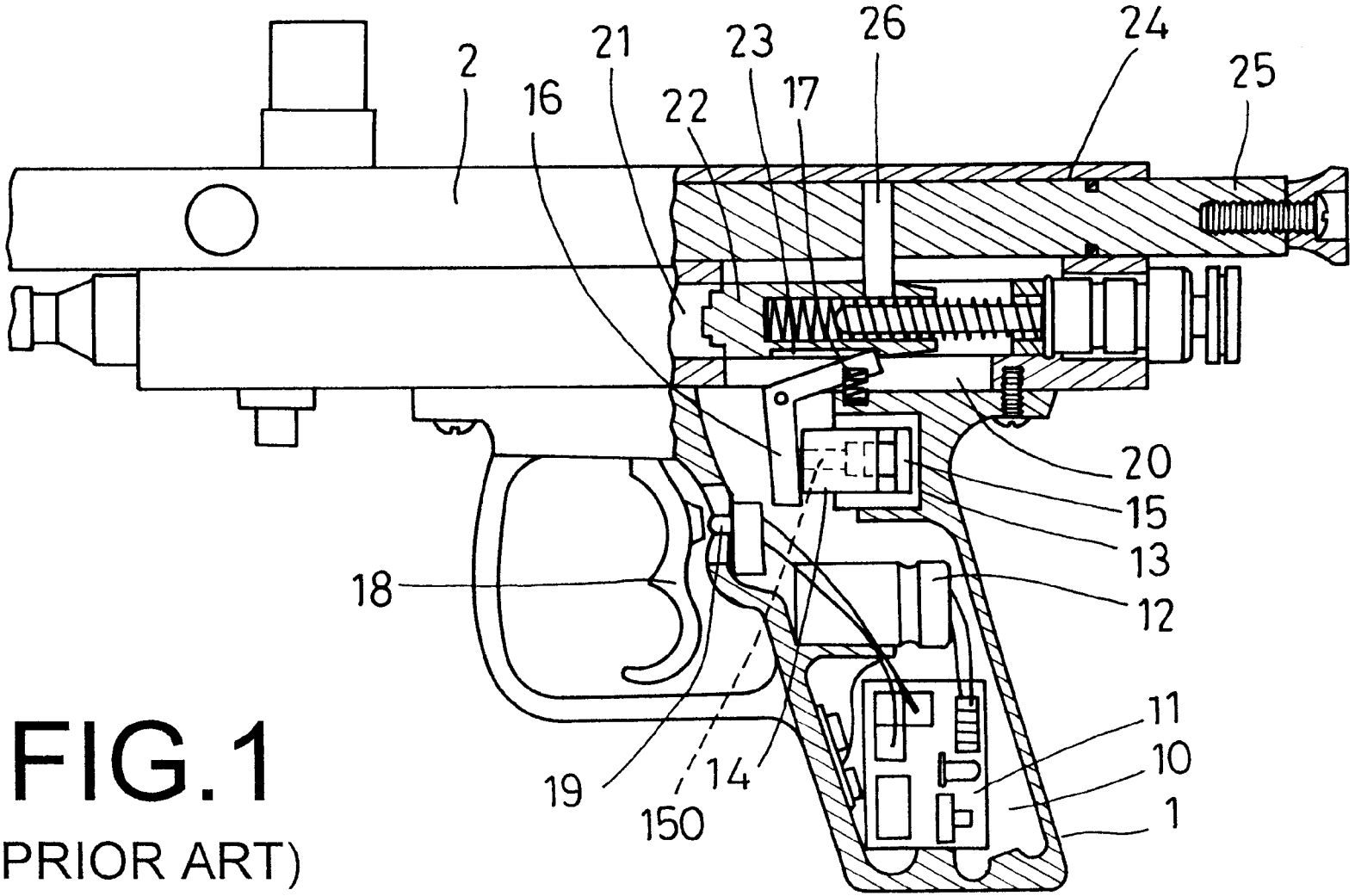
FIG.1 (PRIOR ART)
FIG. 1 is a schematic view of a known conventional paintball gun.
Figure 2:
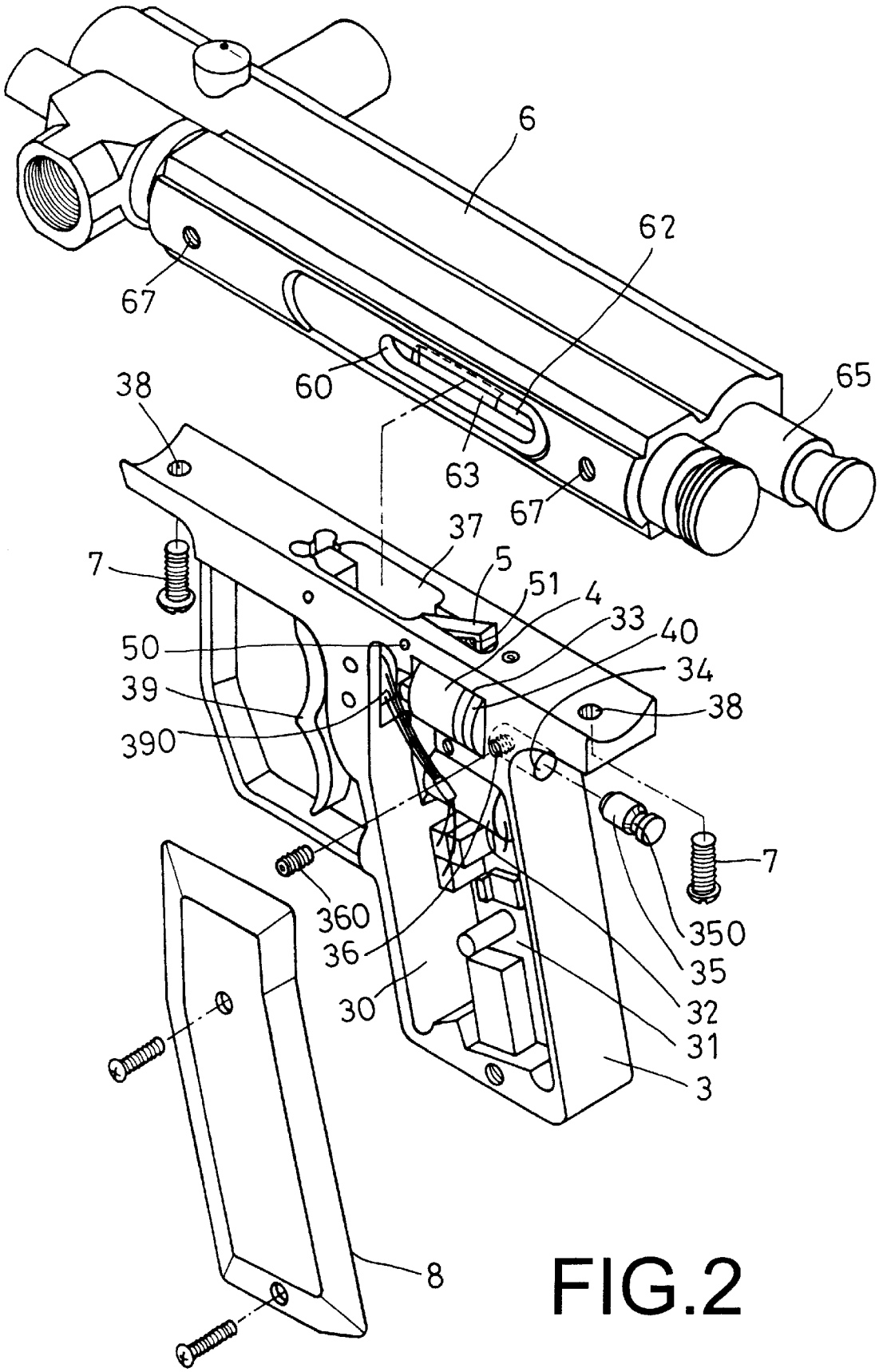
FIG. 2 is an exploded perspective view of a paintball gun conveniently assembled in the present invention.

A preferred embodiment of a paintball gun conveniently assembled in the present invention, as shown in FIGS. 2, 3 4 and 5, mainly includes a grip 3 and a gun body 6. A recess 30 is disposed inside the grip 3 and provided with a circuit board 31 and an electromagnet 32 therein. A chamber 33 is disposed above the recess 30 and communicated with the recess 30. A through hole 34 is formed in a back of the grip 3 and communicated with the chamber 33. A set bolt 35 provided with an engagement groove 350 disposed thereon is capable of being extended into the through hole 34 with an inner end protruded into the chamber 33. A setscrew hole 36 formed in one sidewall surface of the grip 3 and communicated with the through hole 34 is capable of being screwed with a setscrew 360 whose inner end is capable of being pressed against the engagement groove 350 of the set bolt 35 to keep the set bolt 35 in a fixed position. A through groove 37 formed in a top surface of the grip 3 and communicated with the chamber 33. Two through holes 38 is each respectively formed in a front end and a rear end of the top surface of the grip 3. A trigger 39 disposed in front of the grip 3 has an actuator 390 located in back of the trigger 39.

An electromagnetic valve 4 disposed inside the chamber 33 of the grip 3 is provided with a magnetic-attraction plate 40 at one side of the electromagnetic valve 4. The magnetic-attraction plate 40 has a push rod 41 disposed at one sidewall thereof, extended through the electromagnetic valve 4 and protruded from the other side of the electromagnetic valve 4. Moreover, an inner end of the set bolt 35 is capable of being pressed against the other sidewall surface of the magnetic-attraction plate 40.

A locking member 5 is pivoted by a pivot 50 and disposed in the through groove 37 on the top surface of the grip 3. The locking member 5 has an upper end whose top is protruded from the top surface of the grip 3 as well as whose bottom is urged upward by a spring 51 disposed below, and a lower end pressed against by an outer end of the push rod 41.

The gun body 6 fixed on the grip 3 has a slide way 60 disposed at a bottom of the gun body 6 for accommodating the upper end of the locking member 5, and an air chamber 61 provided with a recoil rod 62 therein. A locking groove 63 is formed at a bottom of the recoil rod 62 for firmly engaging the locking member 5. A firing chamber 64 located above the air chamber 61 has a pull rod 65 disposed at a rear of the firing chamber 64 and provided with a linking rod 66 connected with the recoil rod 62, by which a pull of the pull rod 65 will make the recoil rod 62 moved accordingly. Moreover, there are two screw holes 67 formed in the bottom surface of the gun body 6.

Two screw members 7 are respectively extended through the two through holes 38 of the grip 3 and screwed into the two screw holes 67 of the gun body 6 so as to firmly combine the grip 3 and the gun body 6 together.

Two cover plates 8 are respectively covered on both sides of the grip 3.

Figure 3:
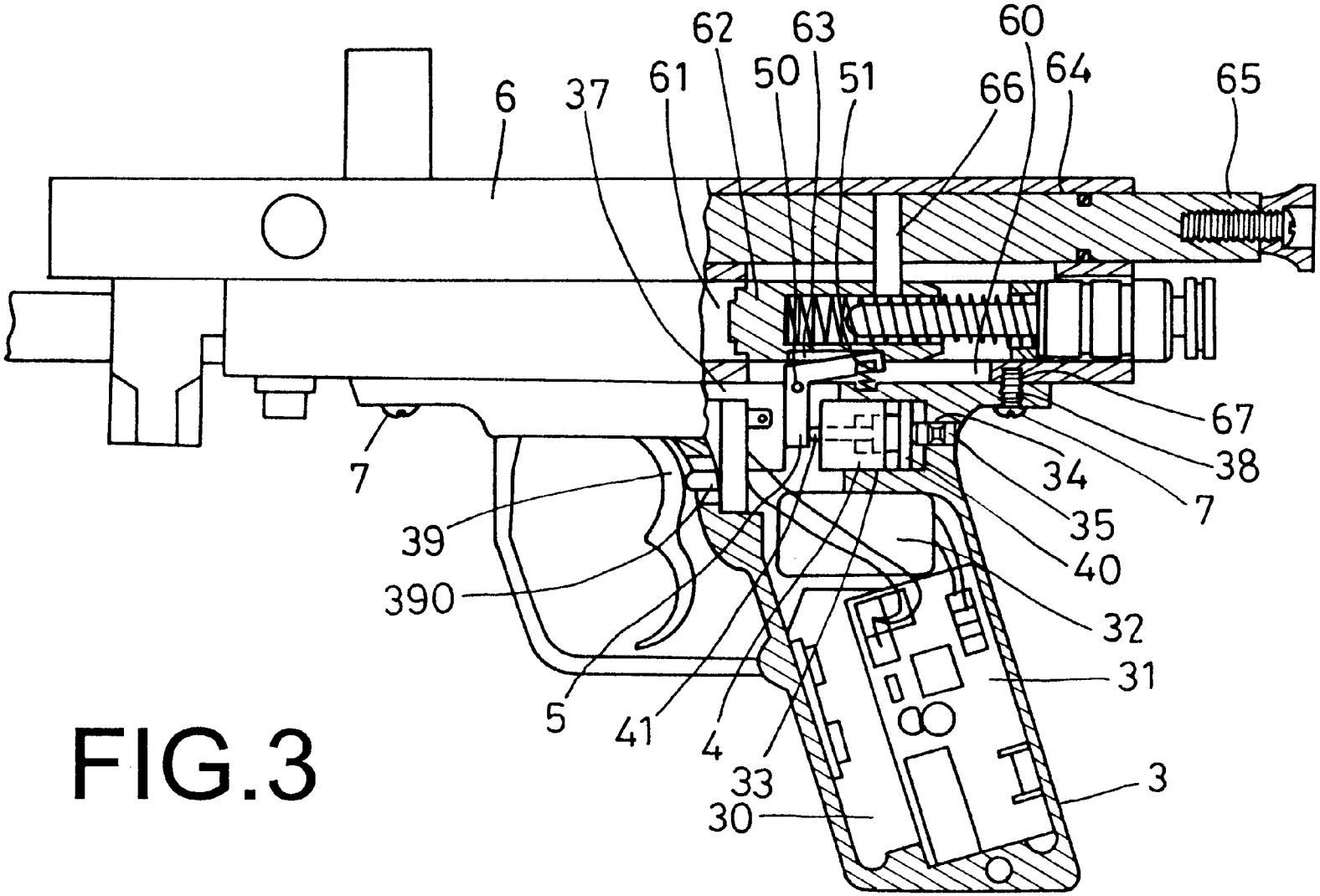
FIG. 3 is a cross-sectional view of the paintball gun conveniently assembled in the present invention.
Figure 4:
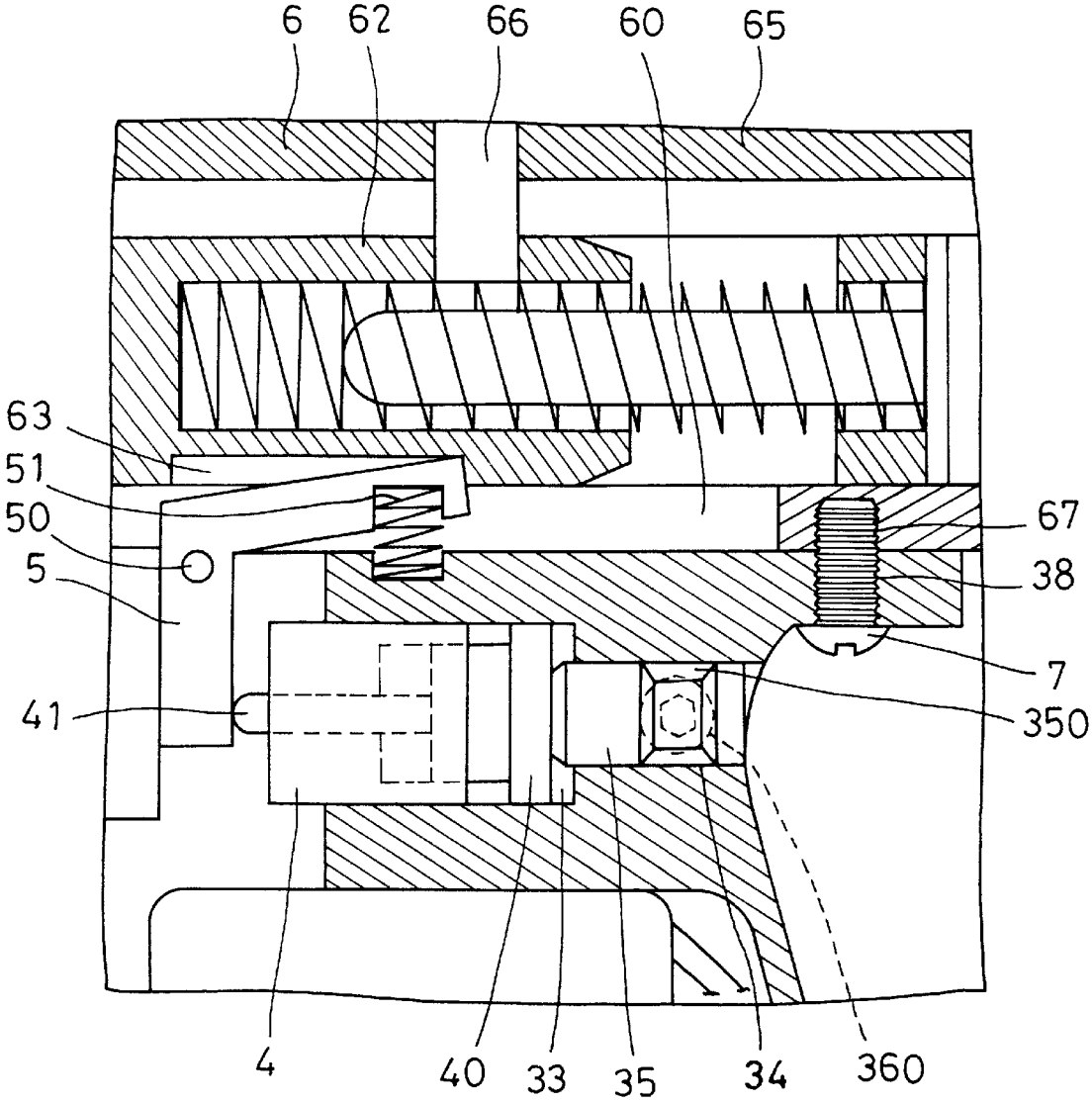
FIG. 4 is a front partial cross-sectional view of the paintball gun conveniently assembled in the present invention; and, FIG. 5 is a top partial cross-sectional view of the paintball gun conveniently assembled.
Figure 5:
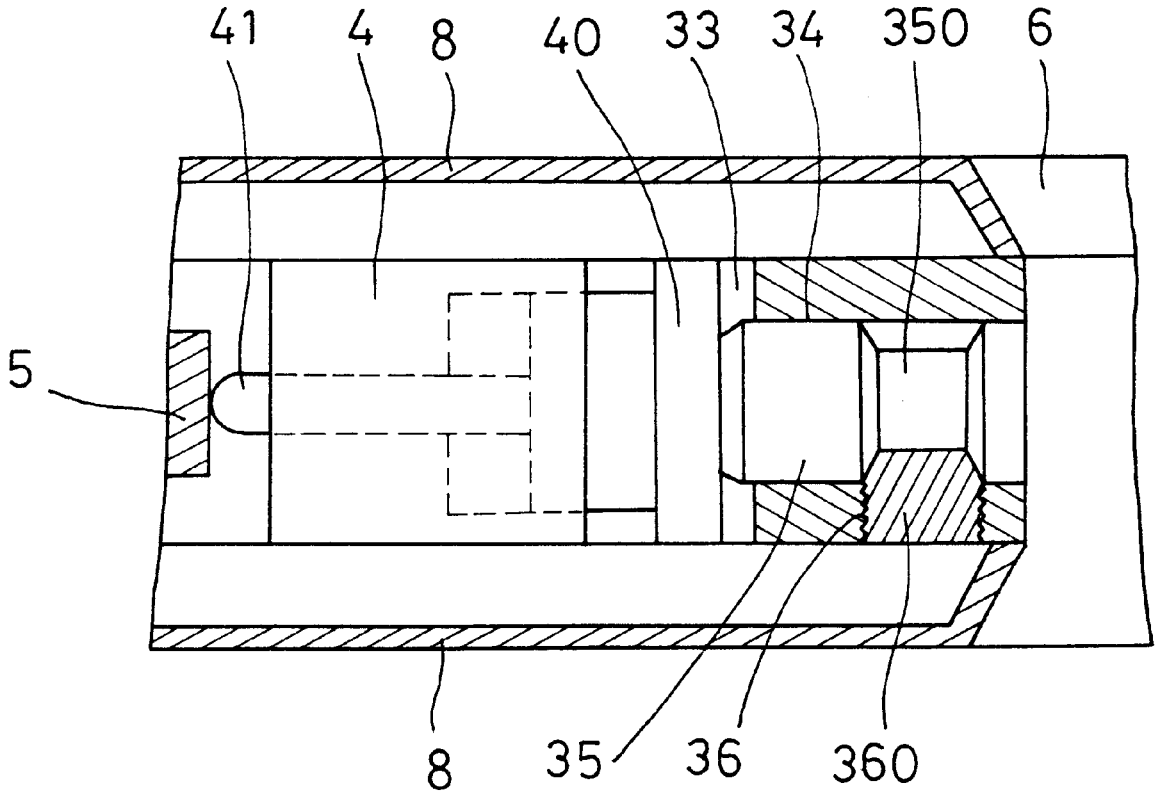

In assembling, referring to FIGS. 3, 4 and 5, when the grip 3 is to be assembled with a different gun body 6, firstly choose one set bolt 35 with a proper length from numbers of set bolts produced with different length for being assembled with the gun body 6. Secondly, extend the set bolt 35 into the through hole 34. Thirdly, screw the setscrew 360 tightly in the setscrew hole 36 with one end of the setscrew 360 pressed against the engagement groove 350 of the set bolt 35 to keep the set bolt 35 in a fixed position, by which the grip 3 can be assembled with gun body 6.

When the length of the set bolt 35 is longer, the magnetic-attraction plate 40 can be pushed by the inner end of the set bolt 35 close to the electromagnetic valve 4 to shorten the distance between the magnetic-attraction plate 40 and the electromagnetic valve 4. Following the inward movement of the magnetic-attraction plate 40, the push rod 41 is moved inward accordingly, by which the lower end of the locking member 5 is pushed outward under the protruding of the outer end of the push rod 41 so as to be away from the electromagnetic valve 4. Meanwhile, the upper end of the locking member 5 with the pivot 50 as the axis will be rotated downward to compress the spring 51 disposed below to make the spring 51 in a compressed status, by which the height of the upper end of the locking member 5 is lowered. On the contrary, when the length of the set bolt 35 is shorter, the upper end of the locking member 5 will be moved upward under the upward urging of the spring 51 disposed below. Meanwhile, the lower end of the locking member 5 with the pivot 50 as the axis will be rotated toward the electromagnetic valve 4 to push the push rod 41 to be moved into the electromagnetic valve 4, by which the magnetic-attraction plate 40 can be moved outward accordingly and pressed against the inner end of the set bolt 35 so as to enlarge the distance between the magnetic-attraction plate 40 and the electromagnetic valve 4 and to heighten the height of the upper end of the locking member 5.

After the set bolt 35 is extended into the through hole 34, the setscrew 360 can be screwed into the setscrew hole 36 tightly with one end of the setscrew 360 engaged in the engagement groove 350 of the set bolt 35 to keep the set bolt 35 in a fixed position. Moreover, using the set bolt 35 of different length to assemble the grip 3 and the gun body 6 can make the magnetic-attraction plate 40 and the push rod 41 pushed and moved to different distances to adjust the displacement height of the upper end of the locking member 5 for being fitted with a locking groove 63 of a different gun body 6 with a different depth so that the grip 3 can be combined with a different type of gun body 6, by which a single grip 3 is suited for being assembled with a gun body 6 of different style to decrease the manufacturing of gun bodies 6 with varied styles, to lower the production cost and to provide a convenient and quick assembly.

While the preferred embodiment of the invention has been described above, it will be recognized and understood that various modifications may be made therein and the appended claims are intended to cover all such modifications that may fall within the spirit and scope of the invention.

What is claimed is:

1. A paintball gun conveniently assembled mainly combined by a grip and a gun body comprising:

said grip having a recess disposed inside said grip and provided with a circuit board and an electromagnet therein, a chamber disposed above said recess and communicated with said recess, a through groove formed in a top surface of said grip and communicated with said chamber, two through holes each respectively formed in a front end and a rear end of said top surface of said grip, as well as a trigger disposed in front of said grip and having an actuator located in back of said trigger;

an electromagnetic valve disposed inside said chamber of said grip and provided with a magnetic-attraction plate at one side of said electromagnetic valve, said magnetic-attraction plate having a push rod extended through said electromagnetic valve and protruded from the other side of said electromagnetic valve;

a locking member pivoted by a pivot and disposed in said through groove formed on said top surface of said grip, said locking member having an upper end whose top is protruded from said top surface of said grip as well as whose bottom is urged upward by a spring disposed below and a lower end pressed against by an outer end of said push rod;

said gun body fixed on said grip with screw members;

two cover plates respectively covered on both sides of said grip;

characterized by a through hole formed in a back of said grip and communicated with said chamber of said grip; a set bolt provided with at least one engagement groove disposed thereon and capable of being extended into said through hole with an inner end protruded into said chamber and pressed against one wall surface of said magnetic-attraction plate; a setscrew hole formed in one sidewall surface of said grip and communicated with said through hole for being screwed with a setscrew; and, Whereby said set bolt designed to have different length for being assembled with a gun body of different style is capable of being extended into said through hole to push said magnetic-attraction plate, and then screwed with said setscrew tightly to keep said set bolt in a fixed position so that said push rod of said magnetic-attraction plate can push said lower end of said locking member to adjust the displacement height of said upper end of said locking member for being fitted with different types of said gun bodies, thus a single said grip is suited for being conveniently and quickly assembled with a gun body of different style.

* * * * *